US006080089A

United States Patent [19]

Nicholson

[11] Patent Number: 6,080,089

[45] Date of Patent: Jun. 27, 2000

[54] TRAINING BAG APPARATUS

[75] Inventor: Robert Steven Nicholson, Knoxville, Tenn.

[73] Assignee: Bollinger Industries, Grand Prairie, Tex.

[21] Appl. No.: 09/013,563

[22] Filed: Jan. 26, 1998

[51] Int. Cl.[7] ..... A63B 69/36; F16M 13/00

[52] U.S. Cl. ..... 482/83; 482/87; 482/90; 248/519; 248/523

[58] Field of Search ..... 248/519, 523, 248/346.2, 910; 482/83–90

[56] References Cited

U.S. PATENT DOCUMENTS

| | | | |
|---|---|---|---|
| 1,240,376 | 9/1917 | Saucier . | |
| 2,818,254 | 12/1957 | Dunn . | |
| 3,794,279 | 2/1974 | Kramer . | |
| 3,841,631 | 10/1974 | Dolan . | |
| 4,145,044 | 3/1979 | Wilson et al. . | |
| 4,486,016 | 12/1984 | Rubin . | |
| 4,591,126 | 5/1986 | Berney . | |
| 4,596,262 | 6/1986 | Tegze . | |
| 4,759,545 | 7/1988 | Grable . | |
| 4,979,754 | 12/1990 | Eisenhart . | |
| 5,112,023 | 5/1992 | Sowers . | |
| 5,207,407 | 5/1993 | Fitzsimmons et al. . | |
| 5,248,140 | 9/1993 | Matherne et al. . | |
| 5,330,403 | 7/1994 | Kuo . | |
| 5,377,976 | 1/1995 | Matherne et al. . | |
| 5,460,353 | 10/1995 | Rittenhouse | 248/901 |
| 5,556,088 | 9/1996 | Mower et al. . | |
| 5,624,358 | 4/1997 | Hestilow . | |
| 5,762,311 | 6/1998 | Triglia | 248/523 |

*Primary Examiner*—Jerome Donnelly
*Attorney, Agent, or Firm*—James E. Bradley; Shawn Hunter; Felsman, Bradley, Vaden, Gunter & Dillon, LLP

[57] ABSTRACT

The invention described in the specification relates to the art of fitness training and in particular to a training bag apparatus which comprises a training bag support base having a planar, substantially circular bottom portion, a dome-shaped upper portion attached to the bottom portion defining a substantially closed cavity therebetween. The upper portion having a dome-shaped outer surface contains a centrally positioned support collar attached thereto and at least two support ribs radiating from the support collar along at least a portion of the outer surface of the upper portion. The support collar and ribs are integrally molded with the upper portion. The base further includes a centrally positioned upstanding projection attached to the bottom portion and a substantially rigid elongate tube removably fitted over the upstanding projection and extending at least from the bottom projection to the support collar. At least the upper portion, bottom portion, support collar and ribs of the apparatus are provided by a one piece molded structure. A flexible column is fitted over at least a portion of the rigid tube and extends vertically upward from the support collar of the base. A striking pad is attached to the column to provide a resilient surface for training activities. The flexible column provides sufficient rebound and/or reflex action without the need for additional springs or complicated mechanical devices.

10 Claims, 2 Drawing Sheets

TRAINING BAG APPARATUS

FIELD OF THE INVENTION

The invention relates to a training bag apparatus for use in fitness and sports training activities.

BACKGROUND OF THE INVENTION

Conventional heavy punching bags are well known. They are often filled with sand and suspended by chains from an overhead structure, such as a ceiling, a beam, or a free standing truss. Because these bags are heavy, they do not rebound rapidly from hits, punches, jabs and kicks. In addition, once these bags are in place, it is difficult to relocate them, because of their weight and because of the beams and trusses required to adequately support the bag. Also, because many people do not own their living space, they are unable to permanently affix the necessary supporting apparatus to the ceiling. Thus, many people are discouraged from using a punching bag within their own home.

Another type of training device is a light weight bag supported on a movable base. These bags may be attached to or slipped over a pole which is attached to the base. In one design, the base rests on the floor. The user must place one foot on the base of the punching bag stand in order to maintain its stability as it is punched. Otherwise, when the punching bag is hit, the force of the hit overturns the punching bag. Because the user must place his or her foot on the base to maintain the stability of the bag while it is in use, the base has a wide circumference which takes up considerable floor space. Also, the large base makes the bag difficult or bulky to move or relocate.

Still another type of punching bag is disclosed in U.S. Pat. No. 5,330,430 and includes an inflatable cylinder-shaped bag and a hollow base. The base may be filled with water or sand to provide weight. Because the base is heavy and substantially rigid, a resilient device such as a spring is required to provide punch reflex. The spring must be attached to the pole either above or below the base to cause the pole to rebound and return to its resting position after the bag is punched. A suitably sized spring is required to achieve the desired reflex action. If the spring gauge is too low, movement of the bag upon punching is hindered. If the spring gauge is too high, the spring will be too flimsy and the bag may not return fast enough or with enough force. Permanent deformation of the spring may also occur over a period of time. The difficulty in designing a simple, inexpensive spring return mechanism which provides suitable reflex action makes such devices burdensome to manufacture on a large scale and results in relatively expensive training devices.

Accordingly an object of the invention is to provide an inexpensive training apparatus for boxing, punching and kicking training activities.

Another object of the invention is to provide a training bag apparatus that is easily relocatable.

A further object of present invention is to provide a training bag apparatus which may be assembled and used in areas of restricted space.

Still another object of the invention is to provide a training bag apparatus that is easy to disassemble and store.

SUMMARY OF THE INVENTION

With regard to the above and other objects and advantages, the invention provides a training bag apparatus comprising a training bag support base having a planar, substantially circular bottom portion, a dome-shaped upper portion attached to the bottom portion defining a substantially closed cavity therebetween, the upper portion having a dome-shaped outer surface, a centrally positioned support collar attached to the upper portion, at least two support ribs radiating from the support collar along at least a portion of the outer surface, the support collar and ribs being integrally molded with the upper portion, a centrally positioned upstanding projection attached to the bottom portion and a substantially rigid elongate tube removably fitted over the upstanding projection and extending at least from the bottom projection to the support collar. At least the upper portion, bottom portion, support collar and ribs are provided by a one piece molded structure. A flexible column is fitted over at least a portion of the tube and extending substantially vertically upward from the support collar for holding a striking pad and a striking pad is attached to the column to provide the training bag apparatus.

In another aspect, the invention provides a training bag support base comprising a planar, substantially circular bottom portion, a dome-shaped upper portion attached to the bottom portion defining a substantially closed cavity therebetween, the upper portion having a dome-shaped outer surface, a centrally positioned support collar attached to the upper portion, at least two support ribs radiating from the support collar along at least a portion of the outer surface, the support collar and ribs being integrally molded with the upper portion, a centrally positioned upstanding projection attached to the bottom portion and a substantially rigid elongate tube removably fitted over the upstanding projection and extending at least from the bottom projection to the support collar, wherein at least the upper portion, bottom portion, support collar and ribs are provided by a one piece molded structure.

A feature of the invention is the integrally molded, substantially one-piece construction which provides a rigid support base for fitness training activities including boxing, kicking and punching a bag attached to the base. The elongate tube and ribs enhance the rigidity of the support collar so that forces applied to the punching bag and column which are not absorbed by the bag and column are opposed by the upper surface of the base so that damage to the base is eliminated.

An advantages of the invention are that the apparatus is relatively inexpensive to manufacture, it can be easily assembled and disassembled, it can be moved readily and it provides a sufficient rebound action upon punching without the need for springs or complicated mechanical linkages. Another advantage of the apparatus is that only the base portion need be weighted, reducing the volume of weighting material required for providing stability during use of the training bag apparatus.

BRIEF DESCRIPTION OF THE DRAWINGS

The features and advantages of the invention will now be described in conjunction with the drawings in which.

DETAILED DESCRIPTION OF THE PREFERRED EMBODIMENT

Figure 1A:
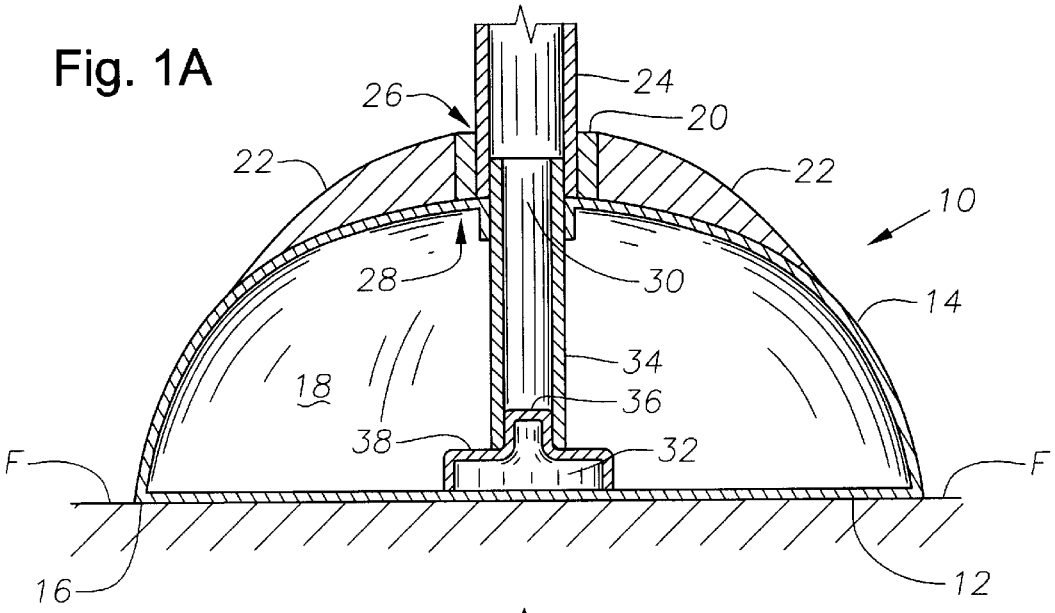
FIG. 1A is a cross-sectional view, not to scale, of a support base according to the invention.
Figure 1B:
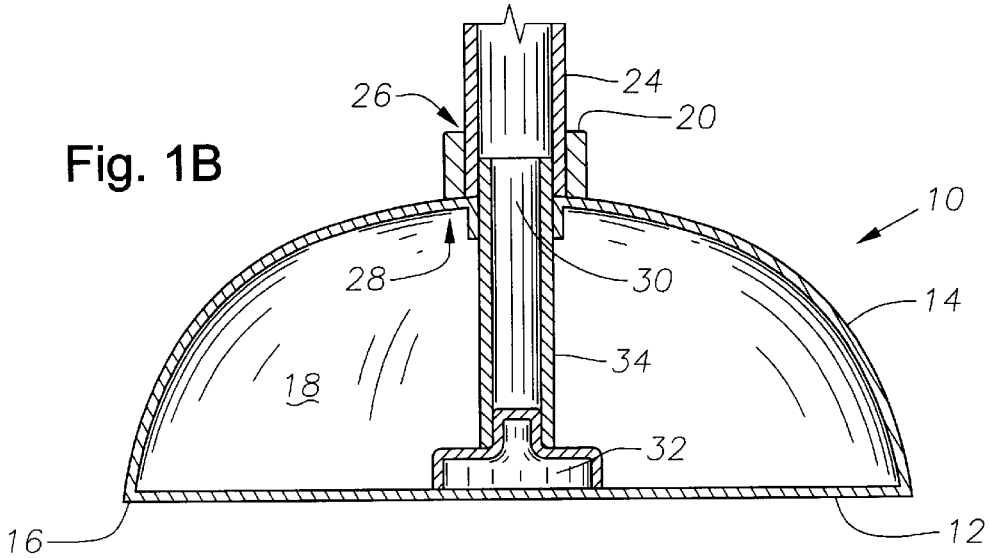
FIG. 1B is a cross-sectional view of the support base of FIG. 1A rotated approximately 90 degrees.

With reference to FIGS. 1A and 1B, there is shown a training bag apparatus 10 in accordance with a preferred embodiment of the invention. The apparatus 10 preferably includes a substantially circular bottom portion 12 and a dome-shaped upper portion 14 attached along its lower perimeter 16 to the bottom portion 12 thereby defining a substantially closed cavity 18 between the bottom portion 12 and the upper portion 14. It is preferred that the bottom portion 12 be pre-arched to provide a substantially convex surface relative to the cavity 18 so that when the cavity 18 is filled with a weighting material as described below, the bottom 12 will lie substantially flat against a support surface, such as floor F.

Figure 1C:
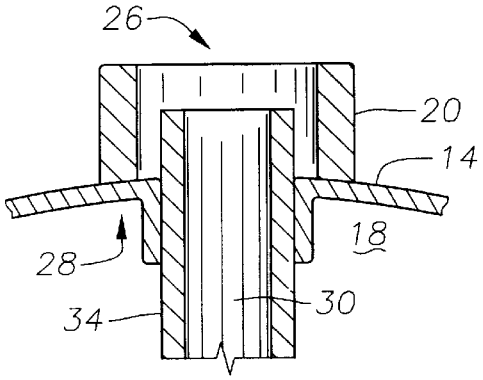
FIG. 1C is a partial cross-sectional view not to scale of a support collar structure attached to a portion of the base 10.

As shown in FIGS. 1A and 1B, the upper portion 14 preferably has a dome-shaped outer surface and a centrally positioned support collar 20, shown in detail in FIG. 1C, attached to the upper portion 14 by plastic welding, gluing or integrally molding the collar 20 and upper portion 14. It is preferred that the dome-shaped upper portion 14 also contain at least two ribs 22 radiating from the support collar 20 and attached to the outer surface of the upper portion 14. The ribs 22 impart support and rigidity to the collar 20 so that forces imposed on a column 24 attached to base 10 at the collar 20 will not tend to fracture the upper surface 14 of the base adjacent the collar 20 during use of a training bag attached to the column 24.

Figure 1D:
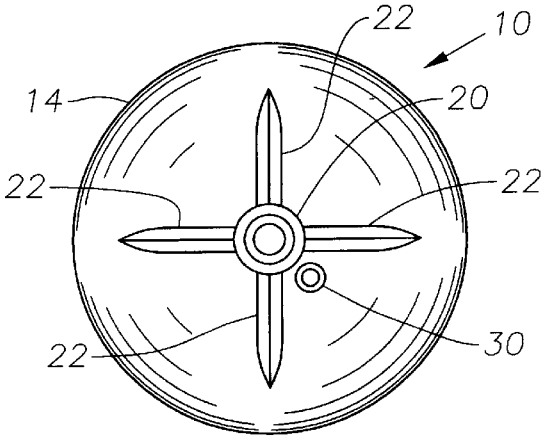
FIG. 1D is a top plan view, not to scale of a support base according to the invention.

FIG. 1D is a top plan view of the support base 10 showing the preferred position of the ribs 22 relative to the support collar 20. As shown, the ribs 22 radiate generally away from the support collar 20 in a radial direction. The base 10 preferably includes at least two opposing ribs 22 and preferably contains at least four or more ribs 22.

Returning to FIG. 1C, the support collar 20 has an open top 26 and a support shoulder 28 surrounding a fill port 30 opposite the open top 26, the fill port 30 being in flow communication with cavity 18. The support ribs 22, support collar 20, upper portion 14 and bottom portion 12 are preferably made of a plastic material and are preferably integrally molded together to provide a substantially one piece base.

A preferred plastic material may be selected from high density polyethylene, high density polypropylene, polystyrene, polyurethane and the like. The base 10 may be made using conventional techniques such as thermoforming, blow molding, rotational molding, injection molding.

In an alternative embodiment, a fill port 30 may be located adjacent to, and preferably on the upper portion 14 of the base 10 as shown in FIG. 1D. When the fill port 30 is located outside of the support collar 20, it is preferred to have a removable closure device such as a screw on cap or plug for closing the fill port 30. A suitable location for such a fill port 30 is substantially midway between adjacent ribs 22 near the support collar 20.

The base 10 preferably also contains a centrally positioned upstanding projection 32 which is attached to the bottom portion 12. The projection 32 provides support for a substantially rigid elongate tube 34 which is removably fitted over the projection 32 and extends at least from the projection 32 to the support collar 20. The tube 34 may be made of any rigid material including metals and plastics and is preferably a polyvinyl chloride pipe having a outside diameter of about 2 to about 4 inches and a length of from about 0.5 feet to about 2 feet. It is preferred that the tube 34 extend past the upper surface 14 into the interior of the support collar 20 at least about 2 inches. The tube 34 may extend above the support collar 20 and into the column 24 to provide additional support and rigidity to the base. Because the tube 34 is positioned in the cavity 18 between the collar 20 and projection 32, it has been observed that when the base is filled with a weighting material, the tube substantially prevents the upper portion 14 of the base 10 from flexing during training activities. Because flexure of the upper portion 14 is substantially eliminated, there is a markedly decreased likelihood that the plastic material of the base 10 will fracture after prolonged or repeated use during training activities. Plastic bases which do not contain the tube 34 and projection 32 have been known to fracture, particularly in the area around the support collar 20. The design of the base described herein substantially eliminates this problem.

When the base 10 is filled with a liquid weighting material such as water, the tube 34 may be inserted in the base after filled. Accordingly, it is preferred that the tube 34 be removable from the base 10 through port 30. In the alternative, the tube 34 may be fixedly attached to the base provided that tube 34 contains one or more openings along the length thereof for use in filling the base 10 with a weighting material such as a liquid or solid. If the solid is free flowing such as sand, than it may be possible to insert the tube 34 into the base after filling the base with the weighting material.

Returning to FIGS. 1A and 1B, the upstanding projection 32 preferably has a nipple portion 36 and a shoulder portion 38. The nipple portion 36 being of a size sufficient to fit within tube 34 to provide stability therefor so that the tube 34 remains substantially centered in the cavity 18 and the bottom of the tube 34 rests atop shoulder portion 38.

Figure 2A:
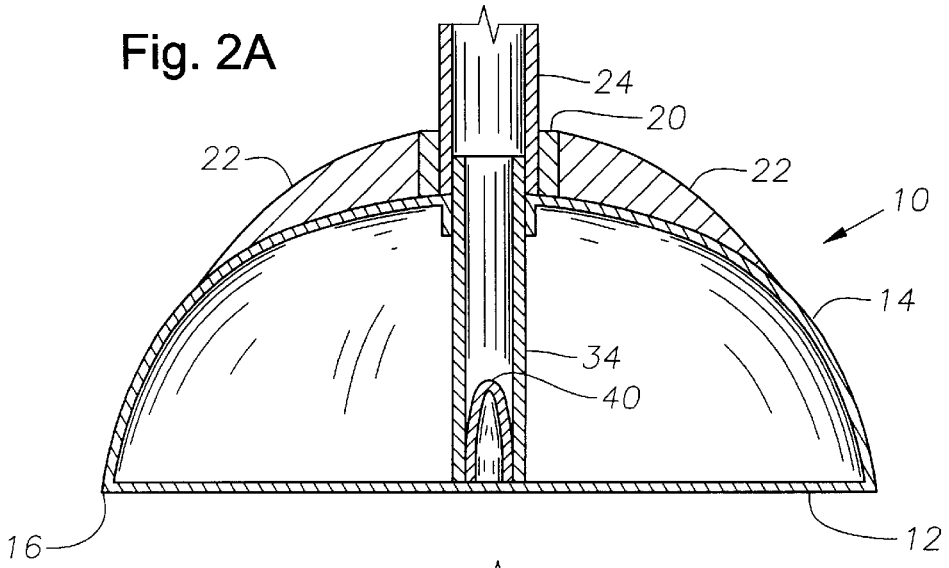
FIG. 2A is a cross-sectional view, not to scale of, an alternative design of a support base according the invention.
Figure 2B:
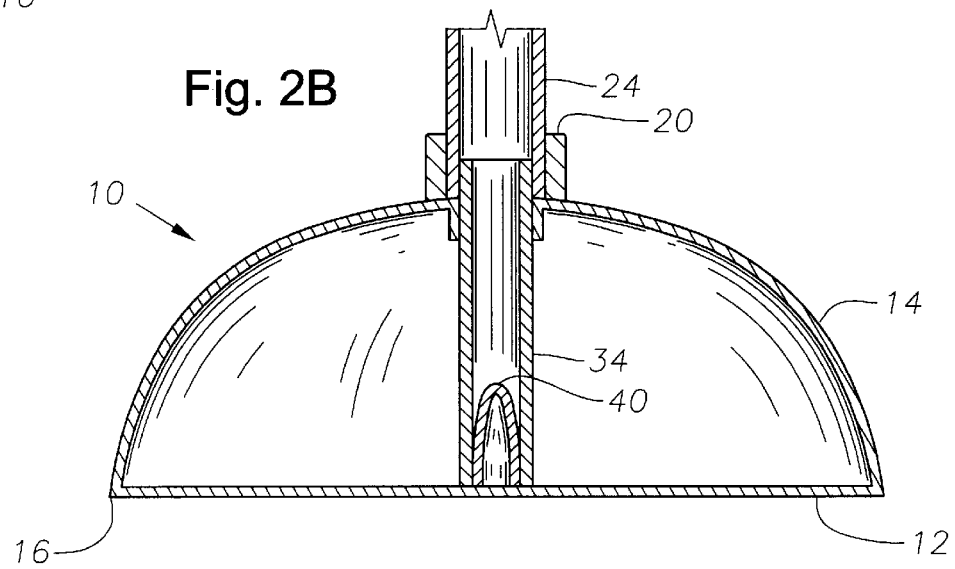
FIG. 2B is a cross-sectional view, of the base of FIG. 2A rotated approximately 90 degrees.

An alternative design for the base 10 is shown in FIGS. 2A and 2B. In this design, the upstanding projection 40 has a substantially conical shape with a largest outside dimension of a size sufficient to fit within tube 34. In this case, the bottom of the tube 34 rests against the inside of the bottom portion 12 rather than on a shoulder 38 as shown in FIG. 1A. Regardless of the design of the projection 32, it is preferred that the projection be integrally molded with the base 10 so that if the base is filled with a fluid such as water, there is no leakage of fluid from the base in the area surrounding the projection 32.

The overall dimensions of the support base 10 are not critical to the invention provided the base is of a size sufficient to provide a desired stability for training activities. For example, support base 10 may be from about 11.0 inches to about 15.0 inches high and from about 24.0 to about 28.0 inches in diameter. The plastic material molded to form the upper portion 14 and bottom portion 12 of the base preferably has a thickness ranging from about 0.3 inches to about 0.8 inches.

As described above, the bottom portion 12 of support base 10 is convex relative to the cavity 18. Hence, the bottom portion 12 is pre-stressed so that when the weighting material is introduced to the cavity 18, the bottom portion 12 maintains a planer engagement with a support surface about the outer perimeter 16 of the support base 10.

In order to fill the support base 10 with a weighting material, individual weighting materials such as water, sand, gravel and the like or combinations thereof, may be poured into the cavity 18 through fill port 30. Because of its size, when filled with water to about 90% of the volume of cavity 18, the base 10 weighs about 150 pounds. Accordingly, in order to move the base 10 to a new location, it is preferred to remove all or a substantial portion of the weighting material. The weighting material may be removed as by inserting a hose or a syphon attached to a pump into the cavity 18 through port 30 so that the end of the hose is below the liquid level (when the weighting material is a liquid), or the base may be tilted on its side and the solid or liquid weighting material poured out through fill port 30. In the alternative, a drain port and plug may be located either on a lower side portion of the upper surface 14 or in projection 32 or 40 and used for removing the weighting material. Because the base 10 is substantially circular, the base may also be moved by tilting the base 10 containing the weighting material and rolling the base on its edge 16 to a new location.

Figure 3A:
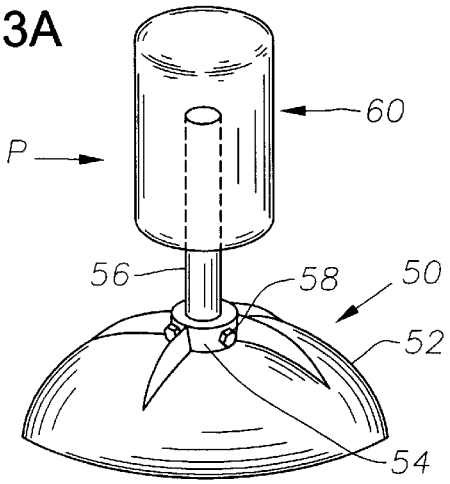
FIG. 3A is a perspective view of a training bag apparatus according to the invention assembled and ready to use.

Referring now to FIG. 3A, a training bag apparatus 50 according to the invention is comprised of a base 52, support collar 54 and flexible column 56 attached to the support collar 54 of the base 52 using fasteners 58 such as thumb screws. The column 56 is comprised of a resilient flexible material such as plastic material which may have a length which is greater than or less than the length of a striking pad 60 attached to the column 56. A preferred column 56 for use with the base 52 has a length of from about 3 feet to about 5 feet and an outside diameter of from about 1.5 to about 4 inches. The inside diameter of the column 56 should be sufficient to fit over the upper portion of tube 34 (FIGS. 1 and 2) so that only the upper portion of the column 56 flexes when a force is applied to the column.

Figure 3B:
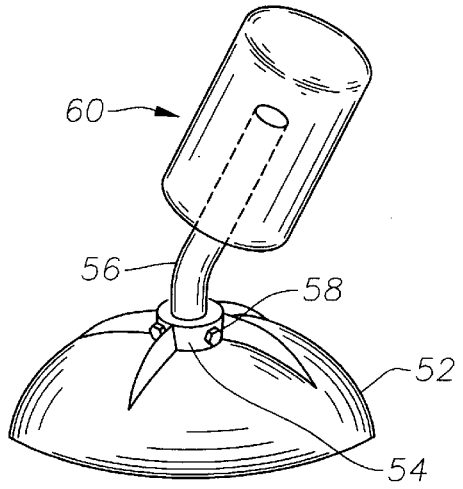
FIG. 3B is a perspective view of the apparatus of FIG. 3A showing movement of the column and pad of the apparatus during use.

The column 56 is preferably sufficiently flexible so that a force applied by a trainee in a direction substantially perpendicular to a pad 60 attached to the column 56, such as by punching or kicking as indicated arrow P, causes the column 56 to flex in an arcuate direction relative to its vertical orientation as shown in FIG. 3B. Because the column 56 is made of a resilient material, after the force on the column 56 or the pad 60 attached to the column is removed the column returns or rebounds to its vertical rest position.

The force which may applied to the pad 60 by a trainee can originate from a variety of sources. For example the force can come from hits, chops, punches, jabs and kicks, during any type of fitness training such as boxing, kick-boxing, martial art self-defense training or general fitness training. Despite the source of the force applied to the pad 60, the training bag apparatus 50, if sufficiently weighted, maintains a substantially fixed position and the flexible column 56 provides a return action for the pad 60 which provides suitable resistance for such training activities.

The striking pad 60 used with the training apparatus is preferably a conventional striking pad having a central bore therein, slightly larger than the diameter of the column 56 in order to provide a friction fit between the pad 60 and the column 56 so that the height of the pad 60 relative to the surface on which the base 52 rests may be adjusted to suit the height or stature of a person using the training apparatus 10.

A pad 60 which may be used with the training apparatus 50 may be constructed of an inner open cell foam material such as polyurethane foam or a closed cell foam material such as polyethylene foam. The foam material is preferably covered by an outer shell which may be made of a natural or synthetic fabric such as canvas, nylon, polyester, leather and the like. The pad 60 is typically from about 14 inches to 38 inches long and from about 8 to about 12 inches in diameter. The central hole in the pad 60 for slipping the pad over the column 56 may have a diameter which is at least about 0.5 inches less than the outside diameter of the column 56. It is preferred that the inner foam material of the pad 60 be relatively light weight, yet of sufficient density to provide suitable training activities.

In order to remove the column 56 from the base 52 in order to fill or empty the base of a weighting material, the fasteners 58 may be loosened or removed from the support collar 54. Removal of the column 56 and pad 60 attached thereto divides the training bag apparatus 50 into smaller components which increases the ease of transport and storage of the apparatus 50.

Having now described the invention and preferred embodiments thereof, it will be recognized by those of ordinary skill that the invention is capable of numerous modifications, rearrangements and substitutions by those of ordinary skill without departing from the spirit and scope of the invention as defined by the appended claims.

What is claimed is:

1. A training bag apparatus comprising:

a training bag support base having a planar, substantially circular bottom portion, a dome-shaped upper portion attached to the bottom portion defining a substantially closed cavity therebetween, the upper portion having a dome-shaped outer surface, a centrally positioned support collar attached to the upper portion, at least two support ribs radiating from the support collar along at least a portion of the outer surface, the support collar and ribs being integrally molded with the upper portion, a centrally positioned upstanding projection attached to the bottom portion and a substantially rigid elongate tube removably fitted over the upstanding projection and extending at least from the bottom projection to the support collar, wherein at least the upper portion, bottom portion, support collar and ribs are provided by a one piece molded structure;

a flexible column fitted over at least a portion of the tube and extending substantially vertically upward from the support collar for holding a striking pad;

and a striking pad attached to the column.

2. The apparatus of claim 1 wherein the base is comprised of a rotocast plastic material.

3. The apparatus of claim 2 wherein the base further comprises a fill port in the support collar for filling the base with a weighting material, the fill port being in flow communication with the cavity.

4. The apparatus of claim 1 wherein the elongate tube extends above the support collar at least about 6 inches.

5. The apparatus of claim 1 further comprising a closable fill port located in the upper surface adjacent the support collar, the fill port being in flow communication with the cavity.

6. The apparatus of claim 1 wherein the column comprises a polyvinyl chloride plastic tube having a outer diameter of about 3 inches and a length of about 3 to about 5 feet.

7. The apparatus of claim 1 wherein the support collar contain a plurality of apertures and a plurality of fasteners therethrough for removably attaching the column to the base.

8. The apparatus of claim 1 further comprising a weighting material at least partially filling said cavity.

9. The apparatus of claim 1 wherein the upstanding projection comprises a substantially cone-shaped projection.

10. The apparatus of claim 9 wherein the cone-shaped projection is integrally molded with the base.

* * * * *